US007367785B2

(12) United States Patent
Roberts

(10) Patent No.: US 7,367,785 B2
(45) Date of Patent: May 6, 2008

(54) REDUCED ICING VALVES AND GAS-DRIVEN MOTOR AND RECIPROCATING PUMP INCORPORATING SAME

(75) Inventor: Charles Oakley Roberts, Edon, OH (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 768 days.

(21) Appl. No.: 10/804,700

(22) Filed: Mar. 19, 2004

(65) Prior Publication Data

US 2005/0207911 A1 Sep. 22, 2005

(51) Int. Cl.
*F04B 17/00* (2006.01)
*F04B 45/00* (2006.01)

(52) U.S. Cl. ..... 417/393; 417/387; 417/395; 137/625.66

(58) Field of Classification Search ..... 417/393–395, 417/387; 137/625.26, 625.27, 625.66; 91/309
See application file for complete search history.

(56) References Cited

U.S. PATENT DOCUMENTS 1,599,275 A * 9/1926 Schultz et al. ..... 91/466
2,679,209 A 5/1954 Fischer et al.
3,652,187 A 3/1972 Loeffler et al.
3,791,768 A 2/1974 Wanner
4,381,180 A 4/1983 Sell
4,436,493 A * 3/1984 Credle, Jr. ..... 417/393
4,549,467 A * 10/1985 Wilden et al. ..... 417/393
4,555,222 A 11/1985 Casilli
4,682,937 A 7/1987 Credle, Jr.
4,854,832 A * 8/1989 Gardner et al. ..... 417/393
5,232,352 A 8/1993 Robinson
5,277,555 A 1/1994 Robinson
5,326,234 A * 7/1994 Versaw et al. ..... 417/393
5,362,212 A * 11/1994 Bowen et al. ..... 417/395
5,368,452 A 11/1994 Johnson et al.
5,391,060 A 2/1995 Kozumplik, Jr. et al.
5,567,118 A 10/1996 Grgurich et al.
5,584,666 A 12/1996 Kozumplik, Jr. et al.
5,957,670 A 9/1999 Duncan et al.
6,241,487 B1 6/2001 Reynolds
6,722,256 B2 * 4/2004 Roberts et al. ..... 91/268
6,901,960 B2 * 6/2005 Roberts et al. ..... 417/395

FOREIGN PATENT DOCUMENTS

SU 1687300 10/1991

* cited by examiner

*Primary Examiner*—Devon C. Kramer
*Assistant Examiner*—Peter J Bertheaud
(74) *Attorney, Agent, or Firm*—Michael Best & Friedrich LLP

(57) ABSTRACT

A valve for a gas-driven motor and a valve assembly and reciprocating pump incorporating the valve are provided. The valve includes a shiftable valve for alternatively supplying a motive gas through first and second supply ports to opposed first and second power pistons in opposed motive gas chambers, respectively, and for effecting alternating exhaust of said chambers. The shiftable valve has a front face with a valve projection located thereon and a rear face with a valve projection located thereon.

13 Claims, 3 Drawing Sheets

REDUCED ICING VALVES AND GAS-DRIVEN MOTOR AND RECIPROCATING PUMP INCORPORATING SAME

BACKGROUND OF THE INVENTION

This invention relates generally to air valves and more particularly to air valves designed to minimize icing and improve efficiency for a reciprocating pump or the like. More specifically, this invention relates to an improved fluid operated, double diaphragm pump, and, more particularly, to the valve construction for such a pump.

The use of a double diaphragm pump to transfer materials is known. Typically such a pump comprises a pair of pumping chambers with a pressure chamber arranged in parallel with each pumping chamber in a housing. Each pressure chamber is separated from its associated pumping chamber by a flexible diaphragm. As one pressure chamber is pressurized, it forces the diaphragm to compress fluid in the associate pumping chamber. The fluid is thus forced from the pumping chamber. Simultaneously, the diaphragm associated with the second pumping chamber is flexed so as to draw fluid material into the second pumping chamber. The diaphragms are reciprocated in unison in order to alternately fill and evacuate the pumping chambers. In practice, the chambers are all aligned so that the diaphragms can reciprocate axially in unison. In this manner the diaphragms may also be mechanically interconnected to ensure uniform operation and performance by the double acting diaphragm pump. Exemplary pumps in this regard are shown and described in U.S. Pat. Nos. 4,854,832 and 5,584,666 (hereafter, "the '832 and '666 patents"), the specifications of which are incorporated herein by reference.

In designing air motor valving used to control the feed air to and exhaust air from the diaphragm chambers of such pumps, however, it is desirable to exhaust the diaphragm chambers as quickly as possible in order to obtain a fast switch over and high average output pressures. Large temperature drops are generated with such rapid exhausting of the diaphragm chambers, however, which cause the valve to become extremely cold and can cause ice formation from moisture in the exhaust air.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

According to the present invention, a valve for a gas-driven motor and a valve assembly and a reciprocating pump incorporating the valve are provided. The valve includes a shiftable valve for alternatively supplying a motive gas through first and second supply ports to opposed first and second power pistons in opposed motive gas chambers, respectively, and for effecting alternating exhaust of said chambers. The shiftable valve has a front face with a valve projection located thereon and a rear face with a valve projection located thereon.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION OF THE INVENTION

Figure 1:
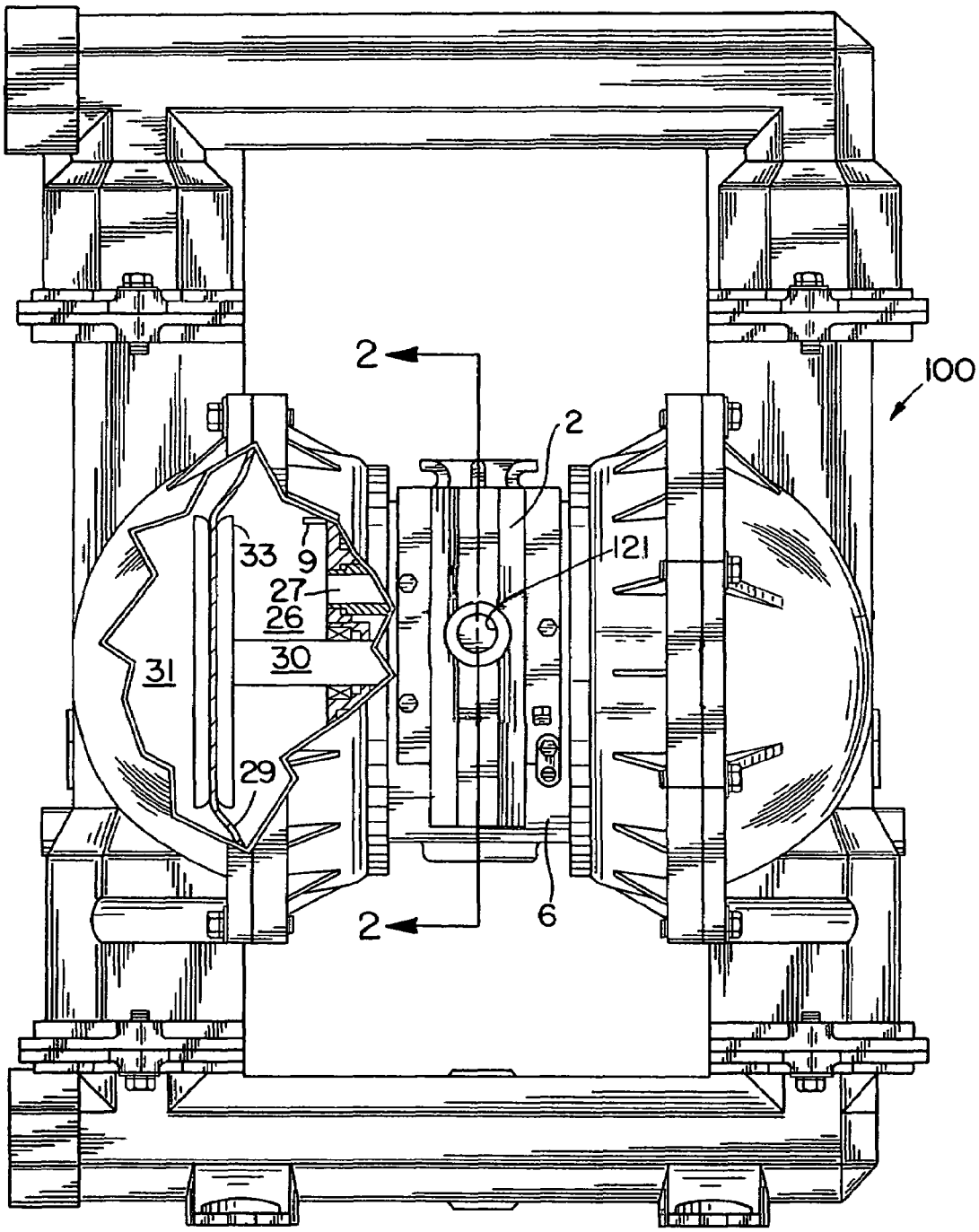
FIG. 1 is an elevational view of a diaphragm pump showing an air motor major valve according to the present invention and showing a left housing chamber in partial section.

Turning to the drawing figures, a double diaphragm pump is shown illustrated incorporating the valve construction of the present invention in which like numbers refer to like parts in each of the figures. According to common practice, the various dimensions of the component parts as shown in the drawings are not to scale and have been enlarged for clarity.

Shown in FIG. 1 is a partial sectional view of a double diaphragm pump incorporating a main housing 100 that defines first and second opposed and axially spaced housing chambers. Each housing chamber includes a pressure chamber 26 and a fluid chamber 31 that are separated by a flexible diaphragm 29 as depicted by the partial sectional view of the left housing chamber as shown in FIG. 1. The pressure chamber, fluid chamber, and diaphragm in the right housing chamber are similarly arranged and form a mirror image of those components in the left housing chamber.

Each of the diaphragms 29 is fashioned from an elastomeric material as is known to those skilled in the art. The diaphragms 29 are connected mechanically by means of a shaft 30 that extends axially through the midpoint of each of the diaphragms. The shaft 30 is attached to the diaphragm 29 by means of opposed plates 33 on opposite sides thereof. Thus, the diaphragms 29 will move axially in unison as the pump operates by the alternate supply and exhaust of air to the pressure chambers of the pump as discussed in greater detail in the '832 and '666 patents. In brief, upon reciprocating the diaphragms of the pump, fluid that passes into each fluid chamber from associated inlet check valves is alternately compressed within and forced outwardly through associated outlet check valves. Operation of the fluid check valves controls movement of fluid in and out of the pump chambers causing them to function as a single acting pump. By connecting the two chambers through external manifolds, output flow from the pump becomes relatively constant.

Figure 2:
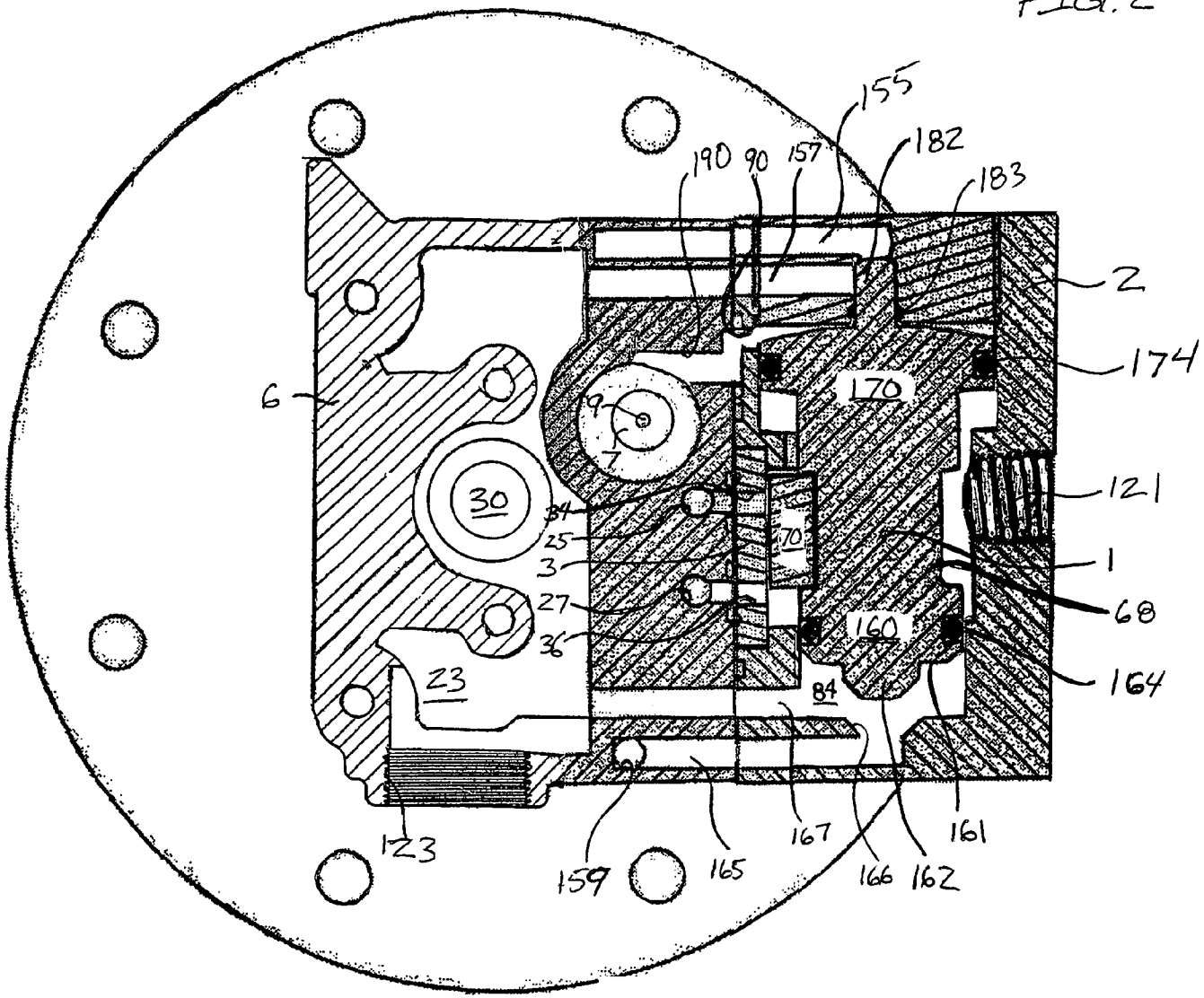
FIG. 2 is a cross sectional view taken along the section line "2-2" in FIG. 1, showing a reduced icing air valve according to the present invention.
Figure 3:
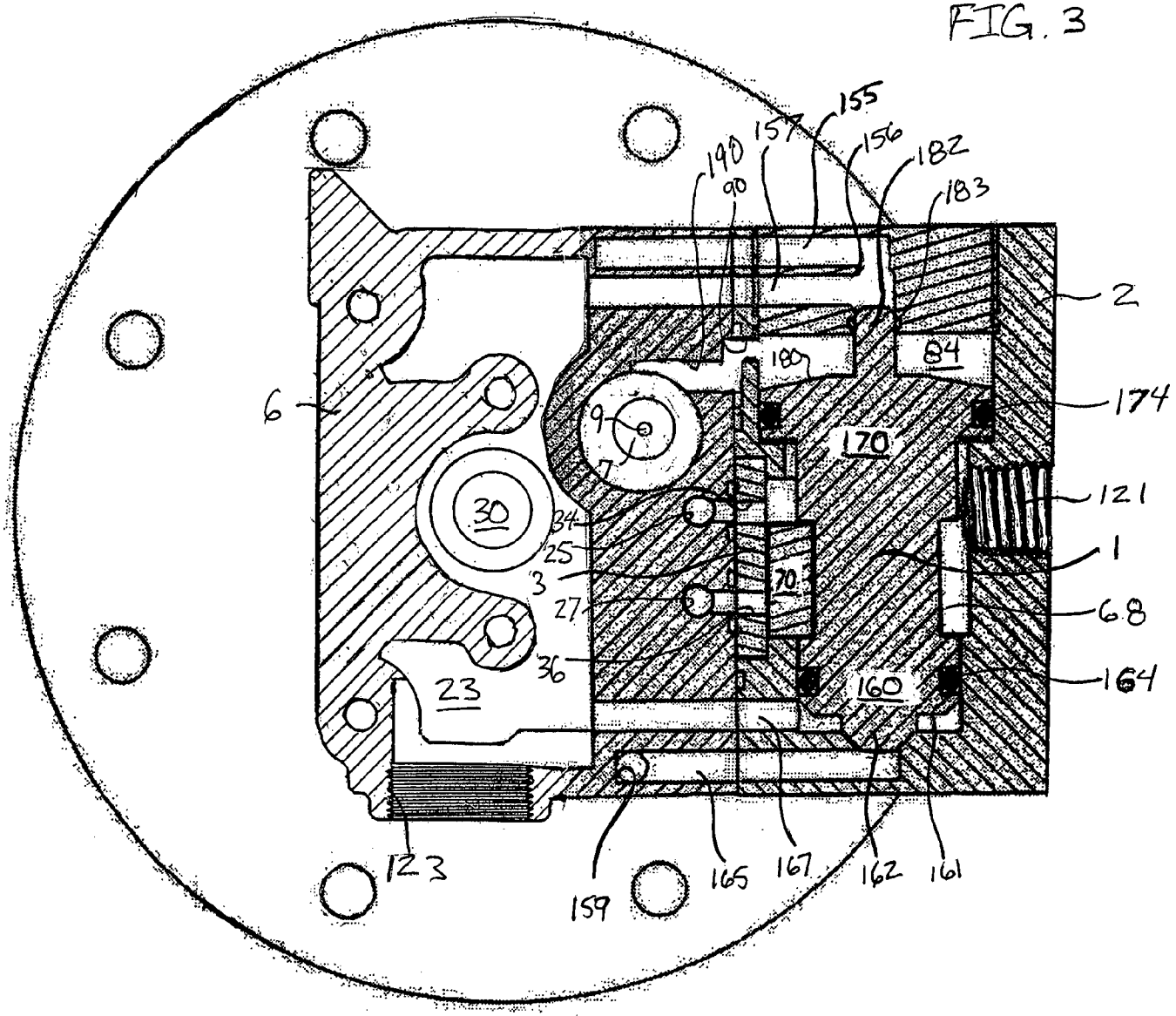
FIG. 3 is the cross-sectional view of FIG. 2 showing the reduced icing air valve according to the present invention sequentially moved to the position as shown.

The specific structure of the present invention relates to the construction of the reduced icing air valve and, more specifically, its major valve construction that provides and exhausts motive gas, respectively, to and from an air motor. Referring to FIG. 1, shown located between the left and right housing chambers is a center body housing 6 to which is attached to a valve block or body 2 having an air inlet 121. As shown in FIGS. 2 and 3, valve block 2 is generally a two piece construction that facilitates the assembly of a major valve, that is comprised of the valve block 2, a spool 1, a valve insert 70, and a valve plate 3, to center body housing 6.

Spool 1 is a differential piston having a large diameter end 170 and a small diameter end 160 as shown in FIGS. 2 and 3. Small diameter end 160 includes a rear face 161 having a valve projection 162. Large diameter end 170 includes a front face 180 having a valve projection 182. Valve projections 162 and 182 may be cylindrical shapes that are chamfered as shown to facilitate sealing respectively against valve seats in the form of constricted regions 166 and 156 described in detail below. Small diameter end 160 and large diameter end 170 also include annular grooves having seals 164 and 174 respectively which engage against the walls of a chamber 84 located in valve body 2. Spool 1 also includes an annular groove 68 which receives a valve insert 70 that extends through the wall of valve body 2 and slides against valve plate 3. Preferably, valve plate 3 and valve insert 70 are constructed of materials that are chemically inert and/or are internally lubricated to minimize chemical compatibility problems and reduce frictional loads, respectively, while also permitting the use of motive gas sources that are dirty.

The motion of valve insert 70 is limited by the wall of valve body 2 to correspond with the range of motion of the travel of the spool 1 in chamber 84. The spacing and position of valve insert 70 and the relative positions of first aperture 34 and second aperture 36 are such as to be consistent with the operation of the device as will be described below. As shown by the sequential movement of spool 1 in FIGS. 2 and 3, valve insert 70 is reciprocally moved to alternately cover first aperture 34 and second aperture 36 defined through the valve plate 3. Supply port 25 is located in center body housing 6 and is in fluid connection with pressure chamber 26 of the left housing chamber, which is located in the paper as shown. Supply port 27 is located in center body housing 6 and is in fluid connection with pressure chamber 26 of the right housing chamber, which is located out of the paper and not shown. By this construction, an air supply provided to air inlet 121 is alternately provided to supply ports 27 and 25 via second aperture 36 and first aperture 34 to fill pressure chambers 26 of the right and left housing chambers, respectively.

Shown in FIG. 2 is an end view of a pilot valve consisting of a pilot piston 7 and an actuator pin 9 that extends into pressure chamber 26 of the right housing chamber. A second actuator pin 9 that is located in line with and on the opposite side of pilot piston 7, extends into the pressure chamber 26 of the left housing chamber as shown in FIG. 1. During operation of the pump, as the diaphragms reciprocate, the diaphragm plates alternately contact the actuating pins causing the pilot piston 7 to shift position. This shift in position of pilot piston 7 causes pneumatic pilot signals to be sent to the front face 180 of spool 1 via a passage 190 and a port 90 and, alternately, to exhaust chamber 23 via an exhaust port in center body housing (not shown). When a pilot signal is provided to port 90 via pilot piston 7, spool 1 shifts downward to the position shown in FIG. 3. When a signal is not provided to port 90, spool 1 shifts upward to the position shown in FIG. 1 due to supply air in chamber 84 acting on the back side of large diameter end 170. In this manner, pilot piston 7 causes spool 1 to shift within valve body 2 at the end of each pump stroke thereby alternating the exhausting and filling of the pressure chambers and their corresponding fluid chambers.

As shown in FIGS. 1 and 2, pressure chamber 26 of left chamber housing (in the paper) is in fluid communication with air supply provided to air inlet 121 via supply port 25 and vented sequentially through exhaust port 159, outer exhaust passageway 165, and inner exhaust passageway 167 to an exhaust chamber 23 that exhausts to atmosphere via an exhaust port 123. Pressure chamber 26 of right chamber housing (out of the paper) is similarly in fluid communication with air supply provided to air inlet 121 via port 27 and vented sequentially through an exhaust port (out of the paper and not shown), to outer exhaust passageway 155, and inner exhaust passageway 157 to exhaust chamber 23. By this construction, the pressure chambers 26 of the left and right housings are alternately exhausted upon reciprocating movement of spool 1 as described in greater detail below.

A constricted region 166 located within valve block 2 defines a valve seat area into which valve projection 162 mates, thereby permitting the opening and closing of the exhaust passageway defined by outer exhaust passageway 165 and inner exhaust passageway 167. Similarly, a constricted region 156 located within valve block 2 defines a valve seat area into which valve projection 182 mates, thereby permitting the opening and closing of the exhaust passageway defined by outer exhaust passageway 155 and inner exhaust passageway 157.

During operation of the pump, air passing from pilot piston 7 through passage 190 to port 90 impinges on front face 180 to cause spool 1 to move to and remain in its extreme bottom position as shown in FIG. 3. An O-ring 183 disposed in valve block 2 to fit circumferentially around valve projection 182, seals and separates chamber 84 from inner exhaust passageway 157. Simultaneously, because of the position of the valve insert 70, supply air from inlet 121 flows through chamber 84 through the first aperture 34 in valve plate 3 and into pressure chamber 26 of the left housing via supply port 25. In this position, valve projection 162 is forced to seat in constricted region 166 thereby sealing off outer exhaust passageway 165 and permitting air pressure chamber 26 of the left housing chamber to fill. By this motion into its seated position, valve projection 162 breaks up any ice that may have formed in the constricted region 166 during the previous exhaust cycle of the pressure chamber of the left housing. Conversely, valve projection 182 is moved out of constricted region 156, thereby opening the pressure chamber 26 of the right housing chamber to exhaust sequentially via outer exhaust passageway 155 and inner exhaust passageway 157. As supply air fills pressure chamber 26 of the left housing chamber, a portion of this air enters outer exhaust passageway 165 via exhaust port 159, thereby warming the outer exhaust passageway 165 prior to its next exhaust cycle while also applying pressure to valve projection 162, which assists the spool to shift and helps alleviate sticking of the spool.

Thus, air pressure acting on the diaphragm 29 in the left housing chamber forces it to the left expelling fluid from the fluid chamber 31 through an outlet check valve. The shaft 30 likewise moves to the left as does the right diaphragm (not shown) which causes air to exhaust from the right pressure chamber. Pumped fluid is drawn into the right fluid chamber while fluid is pumped from the left fluid chamber 31.

As the diaphragms move to the left, movement of the actuator pin located in the right chamber is effected due to engagement of diaphragm plate located therein, thereby forcing the pilot piston to shift and removing the pilot signal to passage 190 and port 90. In the absence of the pilot signal to port 90, the supply air pressure within chamber 84 exerted on the backside of large diameter end 170 causes spool 1, and valve insert 70 with it, to move to its extreme topmost position shown in FIG. 2. Simultaneously, because of the position of the valve insert 70, supply air from inlet 121 flows through chamber 84 through the second aperture 36 in valve plate 3 and into pressure chamber 26 of the right housing chamber via supply port 27. In this position, valve projection 182 is forced to seat in constricted region 156 thereby sealing off outer exhaust passageway 155 and permitting air pressure chamber 26 of the right housing chamber to fill. By this motion into its seated position, valve projection 182 breaks up any ice that may have formed in the constricted region 156 during the previous exhaust cycle of the pressure chamber 26 of the right housing chamber. Conversely, valve projection 162 is moved out of constricted region 166, thereby opening the pressure chamber 26 of the left housing chamber to exhaust sequentially via exhaust port 159, outer exhaust passageway 165, and inner exhaust passageway 167. As supply air fills pressure chamber 26 of the right housing chamber, a portion of this air enters outer exhaust passageway 155, thereby warming the outer exhaust passageway 155 prior to its next exhaust cycle, while also applying pressure to valve projection 182, which assists the spool to shift and helps alleviate sticking of the spool.

Pressurized air then flowing from air inlet 121 into the pressure chamber of the right housing chamber causes the diaphragm located therein to move to the right. This in turn causes the connecting shaft 30 to move the left diaphragm 29 to the right, thereby exhausting the pressure chamber of the left housing chamber and causing the left fluid chamber to fill.

The movement of plate 33 to the right in FIG. 1 will ultimately engage that plate with the actuator pin 9, thereby causing the pilot piston 7 and, in turn, spool 1 back again effecting movement to the left of the diaphragms and shaft 30. In this manner, the reversal of operation of the pump is effected, which will continue to oscillate or cycle as long as air is supplied through the inlet 121.

There has been set forth a preferred embodiment of the invention. However, the invention may be altered or changed without departing from the spirit or scope thereof. The invention, therefore, is to be limited only by the following claims and their equivalents.

What is claimed is:

1. A valve assembly for a gas-driven motor comprising:

a shiftable valve for alternatively supplying a motive gas through first and second supply ports to opposed first and second power pistons in opposed motive gas chambers, respectively, and for effecting alternating exhaust of said chambers;

the shiftable valve having a longitudinal axis and a front face with a valve projection located thereon, and a rear face with a valve projection located thereon, the valve projections being coaxially aligned along the longitudinal axis;

a valve block having a chamber with a front end and a rear end disposed around the shiftable valve and permitting axial movement of the shiftable valve along its longitudinal axis, wherein the front face of the shiftable valve is located in the front end of the chamber and the rear face of the shiftable valve is in the rear end of the chamber; the valve block further comprising inner exhaust passages in fluid communication with the front and rear ends of the chamber, outer exhaust passages corresponding to and in fluid communication with each of the inner exhaust passages, and constricted regions between the inner and outer exhaust passages, the constricted regions configured to define valve seats into which the valve projections mate, such that upon reciprocating movement of the shiftable valve along the longitudinal axis, the inner exhaust passageways are alternately opened to their corresponding outer exhaust passageways.

2. The valve assembly according to claim 1, wherein the valve projections are chamfered.

3. The valve assembly according to claim 1, wherein the shiftable valve is a spool valve having a large diameter end on which the front face is located and a small diameter end on which the rear face is located.

4. The valve assembly according to claim 3, wherein the large and small diameter ends further comprise annular grooves having seals disposed therein.

5. The valve assembly according to claim 4, further comprising a valve insert disposed in an annular groove on the spool valve between the large and small diameter ends, the valve insert moves reciprocally with the shiftable valve to alternately connect the first and second supply ports to a motive gas supply.

6. The valve assembly according to claim 3, wherein the valve block further comprises an O-ring disposed to fit circumferentially around the valve projection on the front face.

7. A reciprocating pump comprising:

a gas-driven motor having opposed first and second power pistons in opposed first and second motive gas chambers;

a shiftable valve for alternatively supplying a motive gas through first and second supply ports to the opposed first and second power pistons in the opposed first and second motive gas chambers, respectively, and for effecting alternating exhaust of the chambers;

the shiftable valve having a longitudinal axis and a front face with a valve projection located thereon, and a rear face with a valve projection located thereon, the valve projections being coaxially aligned along the longitudinal axis;

a valve block having a chamber with a front end and a rear end disposed around the shiftable valve and permitting axial movement of the shiftable valve along its longitudinal axis, wherein the front face of the shiftable valve is located in the front end of the chamber and the rear face of the shiftable valve is in the rear end of the chamber; the valve block further comprising a first inner exhaust passage in fluid communication with the front end of the chamber and an exhaust chamber, a first outer exhaust passage in fluid communication with the first inner exhaust passage and the first motive gas chamber, and a first constricted region between the first inner and first outer exhaust passages; and a second inner exhaust passage in fluid communication with the rear end of the chamber and the exhaust chamber, a second outer exhaust passage in fluid communication with the second inner exhaust passage and the second motive gas chamber, and a second constricted region between the second inner and second outer exhaust passages;

the first and second constricted regions being configured to define valve seats into which the valve projections of their respective front and rear ends mate, such that upon reciprocating movement of the shiftable valve along the longitudinal axis, the inner exhaust passageways are alternately opened to their corresponding outer exhaust passageways.

8. The reciprocating pump according to claim 7, wherein the valve projections are chamfered.

9. The reciprocating pump according to claim 7, wherein the shiftable valve is a spool valve having a large diameter end on which the front face is located and a small diameter end on which the rear face is located.

10. The reciprocating pump according to claim 9, wherein the large and small diameter ends further comprise annular grooves having seals disposed therein.

11. The reciprocating pump according to claim 9, further comprising a valve insert disposed in an annular groove on the spool valve between the large and small diameter ends, the valve insert moves reciprocally with the shiftable valve to alternately connect the first and second supply ports to a motive gas supply.

12. The reciprocating pump according to claim 7, wherein the valve block further comprises an O-ring disposed to fit circumferentially around the valve projection on the front face.

13. The reciprocating pump according to claim 7, wherein the pump is a double-diaphragm pump.

* * * * *